US010827825B2

(12) United States Patent
Allen-Gipson

(10) Patent No.: US 10,827,825 B2
(45) Date of Patent: Nov. 10, 2020

(54) LINT SPIN BRUSH AND METHOD OF USE FOR THE SAME

(71) Applicant: Troi Allen-Gipson, Arlington, TX (US)

(72) Inventor: Troi Allen-Gipson, Arlington, TX (US)

( * ) Notice: Subject to any disclaimer, the term of this patent is extended or adjusted under 35 U.S.C. 154(b) by 0 days.

(21) Appl. No.: 16/392,773

(22) Filed: Apr. 24, 2019

(65) Prior Publication Data

US 2019/0246783 A1 Aug. 15, 2019

Related U.S. Application Data

(63) Continuation-in-part of application No. 15/075,827, filed on Mar. 21, 2016, now abandoned.

(60) Provisional application No. 62/136,686, filed on Mar. 23, 2015.

(51) Int. Cl.

| | |
|---|---|
| ***A46B 13/00*** | (2006.01) |
| ***A46B 13/02*** | (2006.01) |
| ***D06F 58/22*** | (2006.01) |

(52) U.S. Cl.

CPC ..... *A46B 13/001* (2013.01); *D06F 58/22* (2013.01); *A46B 2200/3026* (2013.01); *A46B 2200/3073* (2013.01)

(58) Field of Classification Search

CPC ..... A47L 25/005; A46B 13/00; A46B 13/02

See application file for complete search history.

(56) References Cited

U.S. PATENT DOCUMENTS

| | | | | |
|---|---|---|---|---|
| 2,149,453 | A | 10/1936 | Longeshore et al. | |
| 2,512,394 | A | 6/1950 | Sullivan | |
| 2,570,437 | A | 10/1951 | Ellis | |
| 2,780,009 | A | 9/1953 | Sickel | |
| 2,932,961 | A | 4/1960 | Robbins et al. | |
| 3,217,646 | A | 11/1965 | Sharkey | |
| 3,378,934 | A | 4/1968 | Erickson | |
| 3,721,026 | A | 3/1973 | McCallum | |
| 4,015,307 | A | 4/1977 | Kossak | |
| 4,942,643 | A | 7/1990 | Kincer et al. | |
| 5,220,868 | A | 6/1993 | Dunnam | |
| 5,697,126 | A | 12/1997 | Baker, Jr. | |
| 5,819,354 | A | 10/1998 | Alonso et al. | |
| 7,191,489 | B1 | 3/2007 | Hesth | |
| 7,305,775 | B2 | 12/2007 | Favret et al. | |
| 7,784,141 | B2 | 8/2010 | Knopow et al. | |
| 8,245,347 | B2 | 8/2012 | Goldberg et al. | |
| 8,966,710 | B1 * | 3/2015 | Lozano | A46B 13/02 15/23 |
| 2005/0199265 | A1 * | 9/2005 | France | A61C 17/34 134/6 |

(Continued)

FOREIGN PATENT DOCUMENTS

| | | |
|---|---|---|
| EP | 2171151 | 4/2011 |

*Primary Examiner* — Michael D Jennings

(74) *Attorney, Agent, or Firm* — Ira Domnitz

(57) ABSTRACT

A lint removal device with a hollow handle, a tool head with head gears, brushes, rotation motor and gears, with the brushes in rotational mechanical communication with said tool head gears. The brushes work to remove lint from the lint compartment of a dryer in order to maintain the dryer in proper working order. If lint is not removed from most dryers, clothing placed in the dryer may not fully dry or the dryer might overheat and cause a fire. The present invention is designed to overcome these and other problems.

15 Claims, 6 Drawing Sheets

(56) References Cited

U.S. PATENT DOCUMENTS

| | | | | |
|---|---|---|---|---|
| 2006/0185104 | A1* | 8/2006 | Le | A46B 13/02 15/22.1 |
| 2006/0191089 | A1 | 8/2006 | Gracind et al. | |
| 2007/0033752 | A1 | 2/2007 | Hung | |
| 2007/0108181 | A1 | 3/2007 | Gassman et al. | |
| 2008/0052849 | A1 | 3/2008 | McKay | |
| 2009/0031513 | A1 | 2/2009 | Goldberg et al. | |
| 2009/0113745 | A1 | 5/2009 | Choi et al. | |
| 2010/0154241 | A1 | 6/2010 | Ahn et al. | |
| 2010/0319146 | A1 | 12/2010 | Goldberg et al. | |
| 2014/0109427 | A1 | 4/2014 | Kim et al. | |
| 2014/0330289 | A1* | 11/2014 | Revivo | A45D 34/04 606/131 |

* cited by examiner

LINT SPIN BRUSH AND METHOD OF USE FOR THE SAME

CROSS-REFERENCE TO RELATED APPLICATIONS

This application claims priority to U.S. provisional patent application 62/136,686 filed Mar. 23, 2015, which is incorporated by reference herein in their entirety. This application also claims priority to, and is a continuation in part of, U.S. patent application Ser. No. 15/075,827 filed Mar. 21, 2016, which is incorporated by reference herein in their entirety.

STATEMENT REGARDING FEDERALLY SPONSORED RESEARCH

Not applicable

BACKGROUND

The present invention, and inventive system, is a new and novel invention that works to remove lint from the lint compartment of a dryer, or other machine that generates particulates, in order to maintain the dryer in proper working order. Lint can build up on the walls of the compartment or even float down into the bottom of the compartment. Should the lint catcher fail to retrieve most of the particles and if lint is not removed from most dryers, clothing placed in the dryer may not fully dry, the motor wear down, or the dryer might overheat and cause a fire. It can be costly to replace or repair a system. The present invention is designed to overcome these problems.

Many prior art pieces address cleaning lint traps, but none of the prior art provides a portable lint cleaning apparatus that utilizes a handle, motor, rotating brushes and compactness as found in the present invention.

SUMMARY

In several embodiments of the present invention, the present invention operates under several parameters.

In several embodiments, the present invention is a motorized lint brush that can remove lint from a dryer or other machine. In several embodiment the motorized lint brush is comprised of an elongated handle having a first and second end. In several embodiments of the present invention the first end includes one or more controls which can include a power switch, speed setting and other controls for the invention for modifying the rotation of brushes that are also part of the invention.

In several embodiments of the present invention the motorized lint brush is comprised of a second end which is substantially an elongated hollow handle with a tool head. In several embodiments of the present invention the tool head is adapted to include one, or more, brushes that can rotate when the lint brush is in operation. In some embodiments of the present invention the brushes are arranged along substantially a common axis. In some embodiments of the present invention the brushes are arranged along an axis substantially perpendicular to the hollow elongated handle. In some embodiments of the present invention the brushes and elongated handle form substantially a shape. In several embodiments of the present invention, the lint removal device can be used for a dryer, or other mechanical device that has a lint trap.

In some embodiments of the present invention the elongated handle encloses a motor, a power source, and gearing needed to actuate the brushed to rotate when the device is in use. In some embodiments of the present invention the brushes can rotate in the same direction as each other when the device is in operation. In some embodiments of the present invention the brushes can rotate in the opposite direction as each other when the device is in operation. In some embodiments of the present invention the brushes can be comprised of a variety of bristles designed to collect and hold lint or other small matter. In some embodiments of the present invention the bristles can be of variant sizes, shapes and arrangements on the brush as to vary the lint catching surfaces of the brushes.

In some embodiments of the present invention when in operation, a user can insert the tool head of the present invention in the lint compartment of a dryer, although the tool head could also be inserted into other enclosures that are subject to obtaining lint or other unwanted solids. During operation, in some embodiments of the present invention, the rotating brushes that are attached to the tool head will rotate therein causing lint, or other particulate matter to become attached to the bristles of the brushes. A user can then remove the tool head from the lint enclosure and clean the lint off of the brushes in a manner known in the art for cleaning brushes. The tool head can then be reinserted in the lint enclosures and the brushes re-rotated as need to ensure that the tool head cleans the lint enclosure to the satisfactions of the user.

In some embodiments of the present invention comprises: a lint removal device comprising; a hollow elongated member with a first and second end; a hollow handle in mechanical attachment to said first end of said elongated member; a tool head with head gears in mechanical attachment to said second end of said elongated member; brushes; rotation motor and gears; wherein said brushes are in rotational mechanical communication with said tool head gears; said rotation motor and gears are enclosed in said elongated member and in rotational and mechanical communication with said tool head; said hollow handle further comprising; a power source in electronic communication with a control mechanism; said control mechanism located with a user interface substantially on the exterior of said hollow handle; said control mechanism and said power source in electric an mechanical communication with said motor and gears; wherein initiation of said power source can cause activation of said motor and said gears causing said gears to rotate; said gears rotating causes said head gears to rotate therein causing said brushes to rotate. In some embodiments of the present invention the lint removal device further comprises a motor speed variation control; wherein said motor speed variation control is attached to said handle and in electronic communication with said motor. In some embodiments of the present invention the lint removal device further comprises a lower brush head attachment; wherein said lower brush head attachment is in mechanical communication with said tool head and will rotate when said gears are rotated. In some embodiments of the present invention the lint removal device further comprises said brushes rotate in contrary directions to each other about a central axis. In some embodiments of the present invention the lint removal device further comprises said brushes rotate in the same directions to each other about a central axis.

In some embodiments of the present invention, the present invention is a method for using a lint removal device comprising the steps of; obtaining a lint removal device comprising; a hollow elongated member with a first and second end; a hollow handle in mechanical attachment to said first end of said elongated member; a tool head with gears in mechanical attachment to said second end of said elongated member; brushes; rotation motor and gears; wherein said brushes are in rotational mechanical communication with said tool head gears; said rotation motor and gears are enclosed in said elongated member and in rotational and mechanical communication with said tool head; said hollow handle further comprising; a power source in electronic communication with a control mechanism; said control mechanism located with a user interface substantially on the exterior of said hollow handle; said control mechanism and said power source in electric and mechanical communication with said motor and gears; wherein initiating said power source can cause activation of said motor and said gears causing said gears to rotate; said gears rotating causes said head gears to rotate therein causing said brushes to rotate. In some embodiments of the present invention, the method has the additional steps of; obtaining a motor speed variation control; wherein attaching said motor speed variation control is attached to said handle and in electronic communication with said motor. In some embodiments of the present invention, the method has the additional steps of; obtaining a lower brush head attachment; wherein attaching said lower brush head in mechanical communication with said tool head and will rotate when said gears are rotated. In some embodiments of the present invention, the method has the additional steps of; rotating said brushes in contrary directions to each other about a central axis. In some embodiments of the present invention, the method has the additional steps of; rotating said brushes in the same directions to each other about a central axis.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
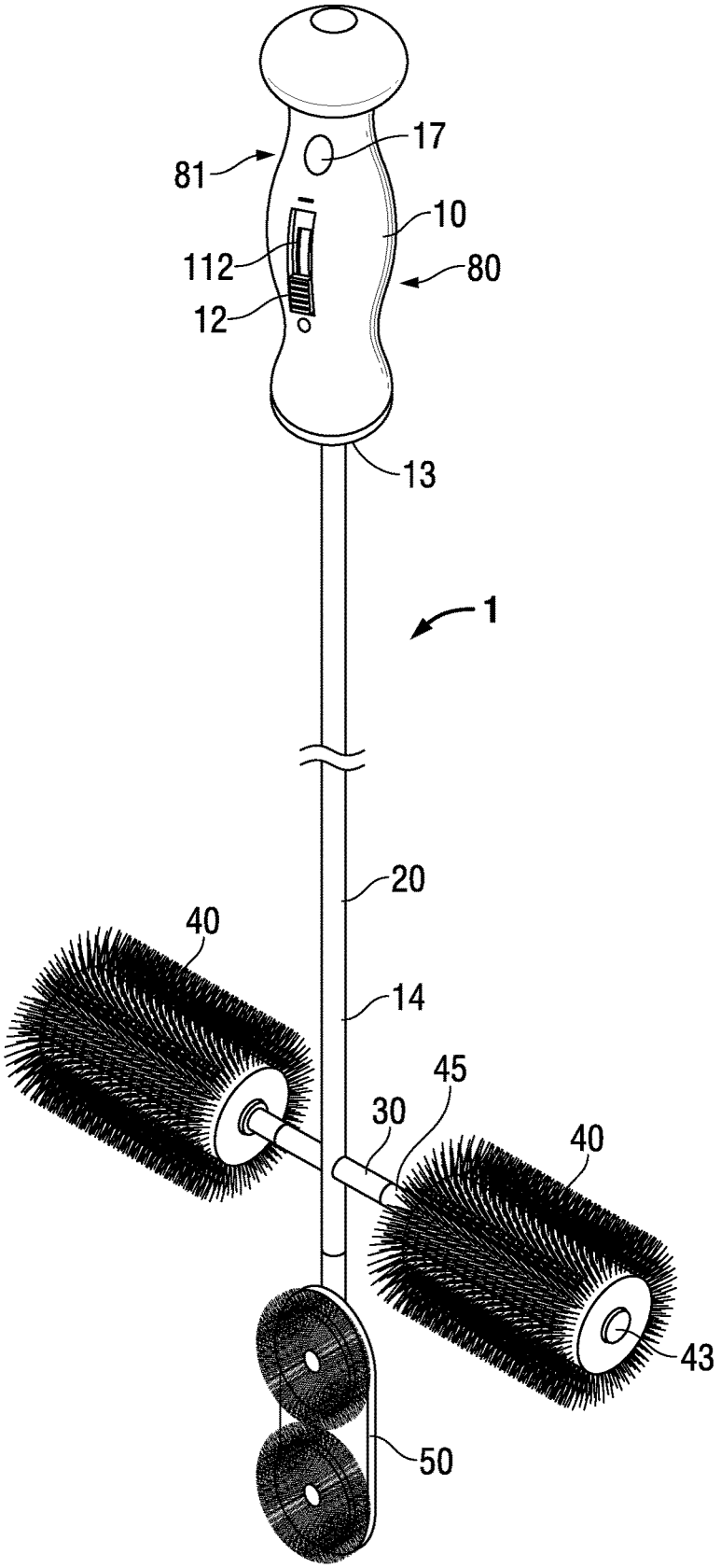
FIG. 1 illustrates one embodiment of the present invention in assembled view with optional lower brushes.

In the following description, certain details are set forth such as specific quantities, sizes, etc. . . . so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale.

One, or more, illustrative embodiments incorporating the invention disclosed herein are presented below. Applicants have created a revolutionary lint spin brush and method for use of the same.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

FIG. 1 illustrates one embodiment of the present invention in assembled view. As shown lint brush 1 is in assembled form. In several preferred embodiments, lint brush 1 is comprised of and upper portion 13 and a lower portion 14. Upper portion 13 is preferably comprised of a handle 10. In several embodiments handle 10 is preferably hollow and contains a motor 1000 (FIG. 2) along with a motor activation switch or control mechanism 12. In several embodiments the present invention has a user interface 112 which is designed in the art to allow for a user to activate a motion action switch 12 through a toggle, button, or slide as is known in the art of engine activation. In several embodiments of the present invention handle 10 may be comprised of plastic, resin, or other materials known in the art for handles. In several embodiments of the present invention handle 10 can be of varying geometric shapes. Switch or control mechanism 12 is located with a user interface 112 substantially on the exterior of said hollow handle 10.

In several embodiments of the present invention, motor 1000 and motor activation switch or control mechanism 12 are of the kinds usually found in the industry for rotating brush motors for medium sized applications such as shoe shinning rotation motors. In several embodiment of the present invention motor 1000 is located inside of the handle 10 and is in electronic communication with motor activation switch or control mechanism 12 in such a manner as that when motor activation switch is moved from an "on" to "off" position motor 1000 will initiate and start rotation. In some embodiments of the present invention regulator 17 can be attached exterior to handle 10 and being both mechanical and electric communication with motor 1000 so as to allow the regulation of motor rotation as is known in the art. In several embodiments of the present invention, motor 1000, activation switch or control mechanism 12, and batteries 14 (FIG. 2) can be located in tool head 30, elongated member 20, or handle 10.

Figure 2:
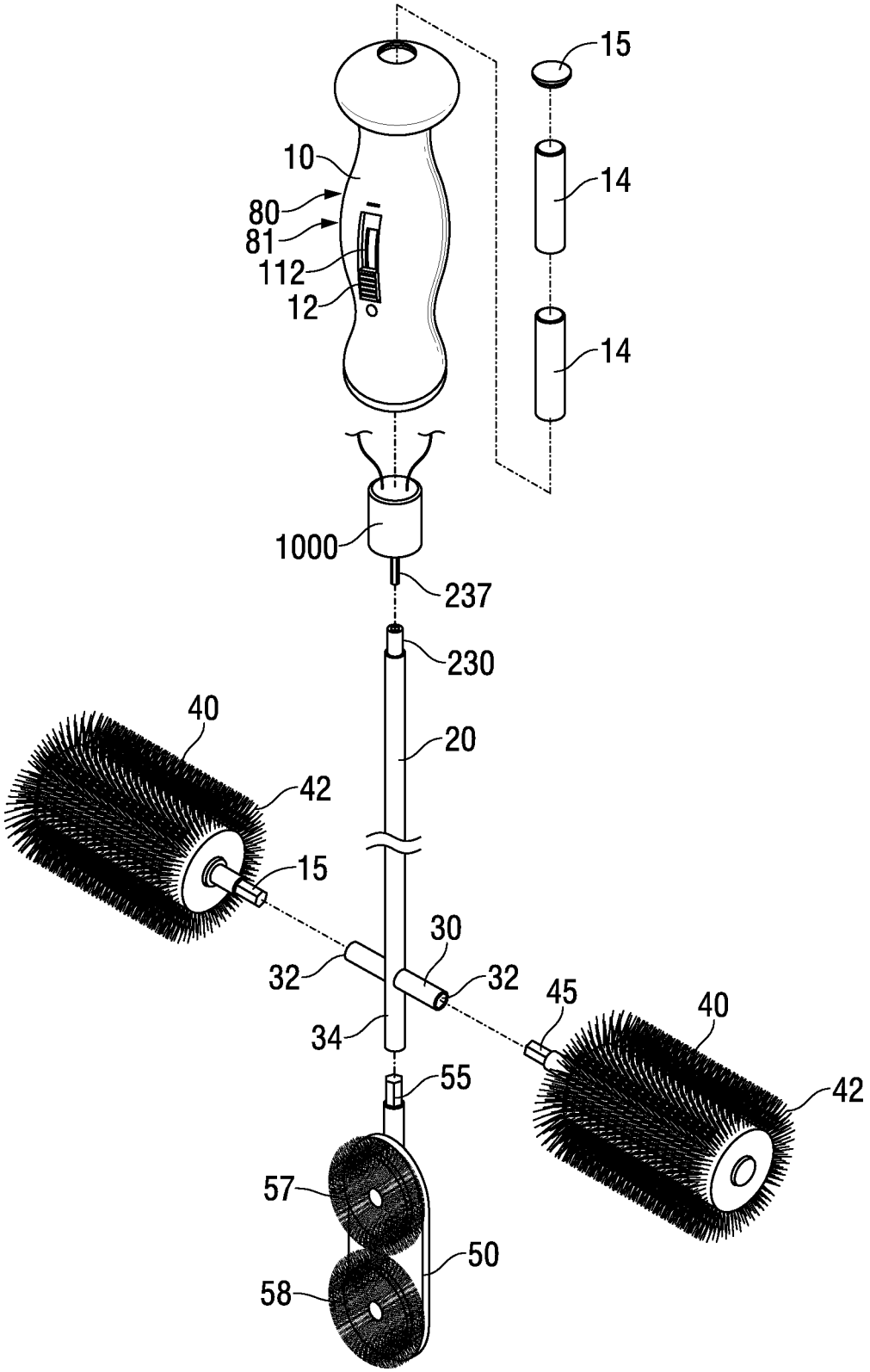
FIG. 2 illustrates one embodiment of the present invention in partially exploded view with optional lower brushes.

Also illustrated is the hollow elongated member 20. As illustrated in FIGS. 6A-D, elongated member 20 is hollow and contains a drive shaft 230. Drive shaft 230 is in mechanical communication with motor 1000 as in known in the art through male member attachment 237. At the lower portion 14 of hollow elongated member 20 is the tool head 30. As illustrated in several embodiments of the present invention tool head 30 is comprised of three hollow shafts 32, 34 (FIG. 2). Elongated member 20 may be comprised of plastic, solid resin, metal or other materials known in the art hollow member. Hollow member 20 may be of variant shape or length as known in the industry. Tool head 30 may be comprised of metal, plastic, or other materials known in the art and may be of variant shapes and geometric configurations. In several embodiments of the present invention, activation switch or control mechanism 12 and motor 1000 can be located in elongated member 20.

Figure 7:
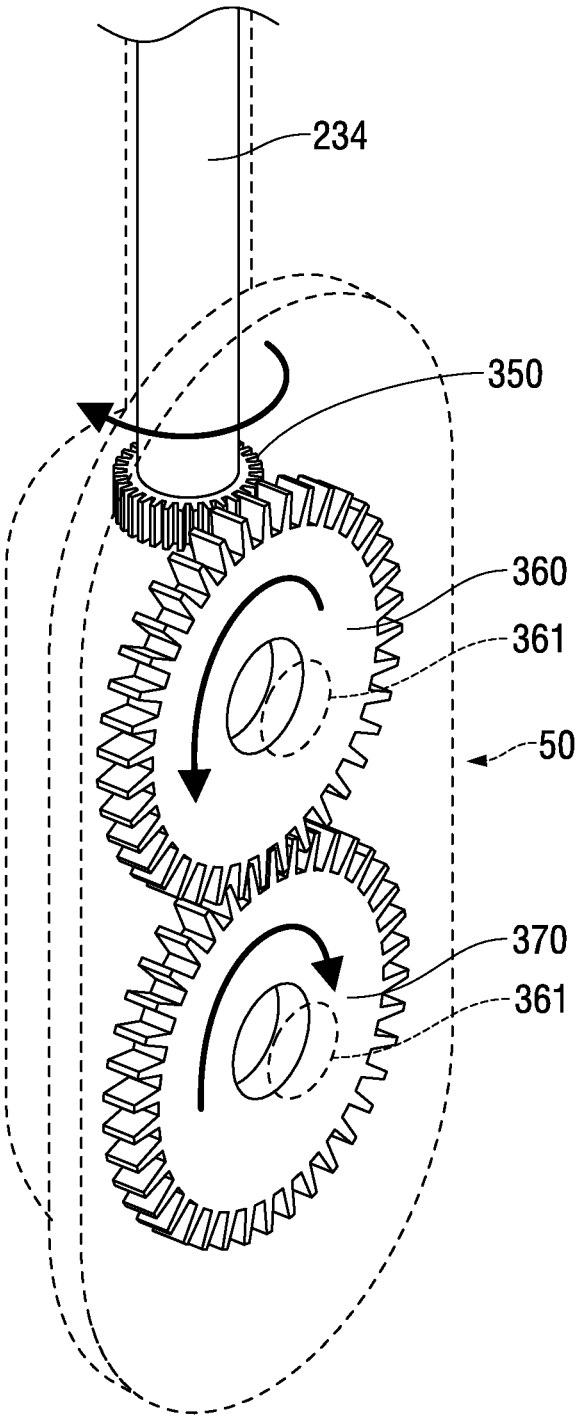
FIG. 7 illustrates one embodiment of the present invention with hidden lines allowing for viewing of the gear mechanisms of the optional lower brush head.

In several embodiments of the present invention and attached to tool head 30 are the brush heads 40. Brush heads 40 attach to tool head 30 in various embodiments via male mating member 45. Brush heads 40 are secured to male member 45 by cap 43 located distal to tool head 30. In several embodiments cap 30 can threadably attached the interior of male member 45 as is known the art for securing brush heads. In several embodiments of the present invention, brush head 40 are designed to rotate when lint brush 1 is in operation and motor 1000 in activated. FIG. 1 also shows optional rotation brush head 50. Brush head 50 is an optional attachment on lint brush 1 and is, in some embodiments, attached to tool 30 in mechanical communication via drive shaft 234 (FIG. 7)

When in operation (FIGS. 1-7) a user can turn switch or control mechanism 12 from "off" to "on" which will electronically engage motor 1000 to activate and rotate drive shaft 230 via male engaging member 237. Drive shaft 230 which is in mechanical communication with gear 302 will cause gear 302 to rotate in the same direction as shaft 230. Gear 302 will cause rotation of 303 and counter rotation of gear 301. Gears 301 and 303 are in mechanical communication with drive shafts 232 causing them to rotation in contrary motion to each other. Drive shafts 232 directly mechanically interact and attach to brush head mating member 45, hence causing brushes 40 to rotate. In order to stop the rotation of brush heads 40, the activation switch or control mechanism 12 is merely turned off. In some embodiments of the present invention it is envisioned the differed gear arrangements 300 can be implemented by one of ordinary skill in the art. In some embodiments of the present invention it is also envisioned that regulator 17 can be utilized to regulate the speed of motor 1000 as is known in the art.

FIG. 2 illustrates a partially exploded view of one embodiment of lint brush 1. As illustrated handle 10 contains batteries 14 and cap 15. Batteries 14 are inserted into handle 10 as are known in the art for powering a motor. Batteries 14 can be of a rechargeable or disposable variety. Cap 15 is preferably designed to encapsulate batteries 14 into handle 10 to prevent them from falling out during use of lint brush 1 as is known in the art. Further illustrated in FIG. 2 is motor 1000. Motor 1000 is preferably constructed with sufficient torque and power to enable the rotation of brushes 40 when the lint bush 1 is in operation as a minimum empowerment threshold. Motor 1000 is preferably in electronic communication with switch or control mechanism 12 such that switch or control mechanism 12 can activate motor 1000 as is known in the art for turning on and off a motor. Motor 1000 is preferably in mechanical communication with drive shaft 230 via male engagement member 237 as is known in the art. Motor 1000 is demonstrative of one mode of motor communication for rotation of brushes 40, other motorized implementation methods as known in the art can be utilized.

FIG. 2 also illustrates hollow tool shafts 32 and 34. In several embodiments of the present invention shafts 32 can accept the male mating member 45 located on the junction side of brush 40. Member 45 and shaft 32 are preferably designed to be constructed such that shaft 30 houses drive shaft 232 such that member 45 and drive shaft 232 can mechanically mate and releasably attach to one another. Also illustrated is rotational brush head 50. Rotational brush head 50 is optional in some embodiments and is preferably constructed with two rotating brush heads 57 and 58. During operation heads 57 and 58 can rotate (See FIG. 7). Bristles 42 on brushes 40 may be constructed of variant length in some embodiments. In some embodiments bristles 42 are preferably comprised of plastic, metal or other materials commonly utilized in the art as rotating brush bristle materials. Head 50 may be attached to shaft 34 through mating male member 55 located distal to heads 57 and 58.

Figure 3:
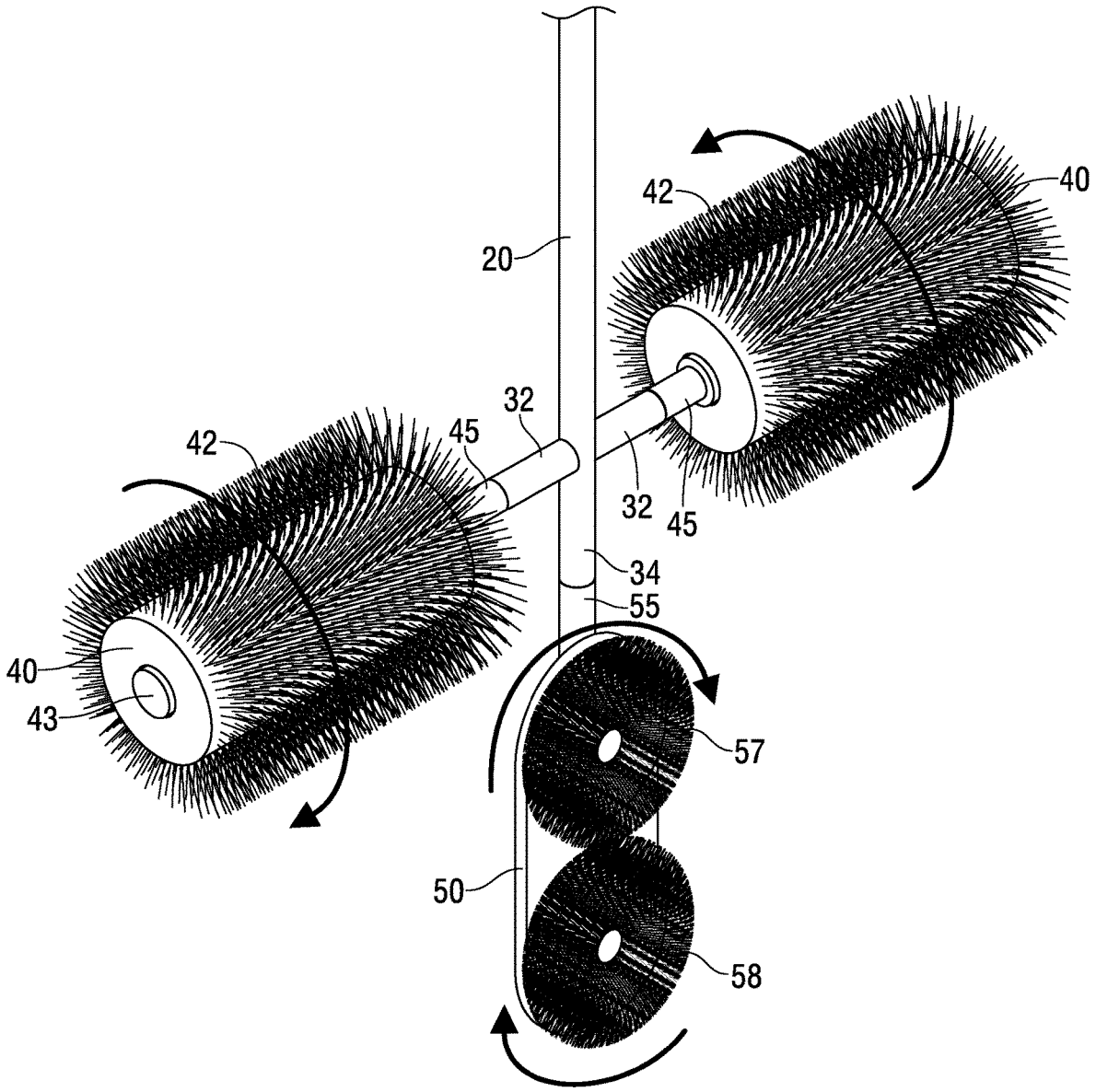
FIG. 3 illustrates one embodiment of the tool head of the present invention.

FIG. 3 illustrates an enlarged view of the tool head 30. As illustrated brushes 40 are attached to tool head 30 by the mating of male member 45 and shaft 32 in a manner designed to ensure releasable mechanical communication. Also illustrated are end caps 43 which maintain brush 40 on drive shaft 232. When end caps 43 are removed brushes 40 can be removed for brush 40 cleaning. Also shown is head 50 which is attached tool head 30 through shaft 34 via mating member 55 in releasable mechanical attachment with shaft 34. See also FIG. 7. As shown, in some embodiments when in operation heads 57 and 58 rotate in the same direction. See also FIG. 7. As shown, in some embodiments brushes 40 can rotate in opposite directions when the lint brush 1 is in operation. It is envisioned that it is known in the art to rearrange gears 300 to allow for rotation in the same direction as in known in the art see (FIG. 6A).

Figure 5:
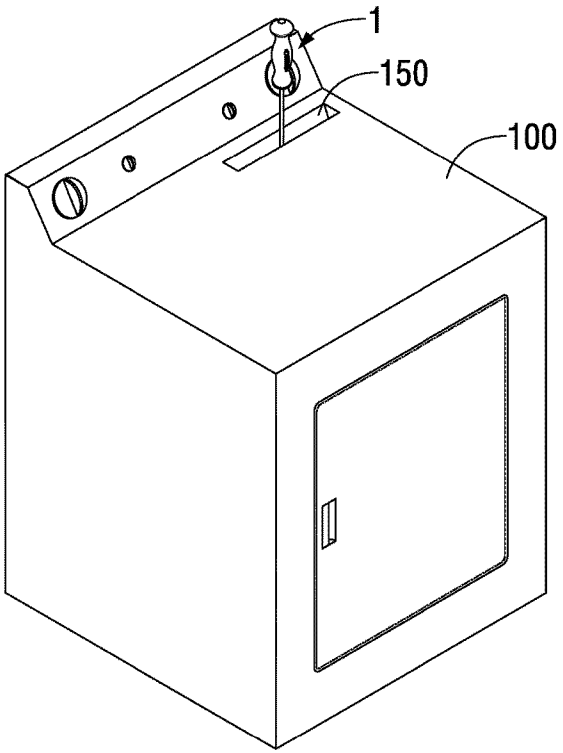
FIG. 5 illustrates one embodiment of the present invention being inserted into a dryer lint trap.
Figure 4:
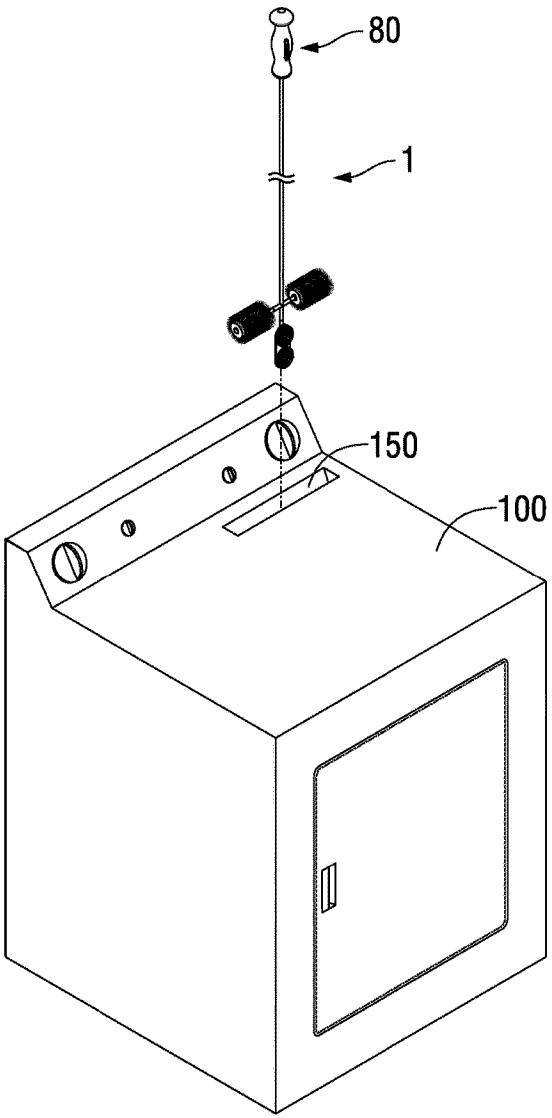
FIG. 4 illustrates one embodiment of the present invention exterior to a dryer.

FIG. 4 illustrates the lint brush 1 as it is about to be inserted into a standard dryer 100. As shown standard dryer 100 has a top lint trap 150. Present invention 1 can be utilized with any lint trap 150 on any dryer though. The standard dryer 100 need not be a dryer and can actually be any device that generates particulates that are trapped in a filter or lint trap 150. FIG. 5 illustrates the lint brush 1 as it is inserted into a stand dryer 100. During operation brushes 40 (and optionally 58 and 58) rotate therein causing the bristles 42 to contact and remove particulates for a lint trap 150.

Figure 6A:
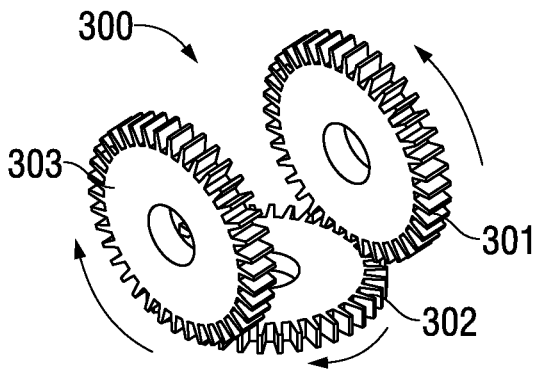
FIG. 6A illustrates one embodiment of an interior view of a potential gear arrangement of one embodiment of the present invention.

FIG. 6A illustrates one example of the gears 300 found inside the tool head 30. As illustrated, when empowered by motor 1000 as is commonly known in the art, gear 302 will engage gears 301 and 303 causing them to counter-rotate. Gears 300 are preferably of a size and construction known in the art for gears utilized in a gear box 130 capable of fitting in the tool head 30.

Figure 6B:
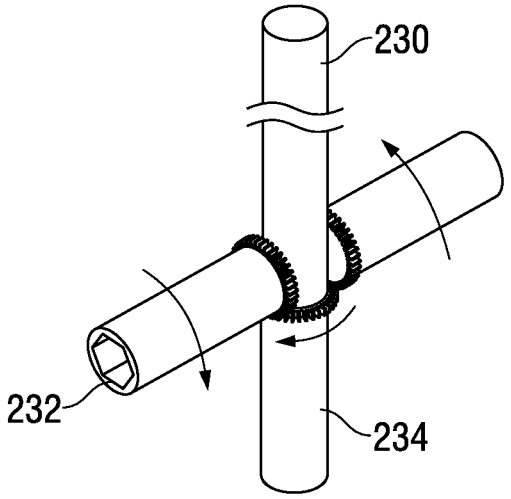
FIG. 6B illustrates one potential embodiment of a drive shaft arrangement for the interior of the tool head of one embodiment of the present invention.

FIG. 6B illustrates the drive shaft 230 which, in some embodiments of the present invention, is located in the hollow interior of elongated shaft 20. Drive shaft 230, in some embodiments is in direct mechanical communication with motor 1000 such that when motor 1000 is initiated, drive shaft 230 rotates causing the rotation of gear 302 and therein gears 301 and 303. As shown drive shaft 230 is in direct mechanical communication with gear 302. Also shown, is optional drive shaft 234 is in mechanical communication with the lower portion of gear 302 which is also in attachment with drive shaft 230.

Figure 6C:
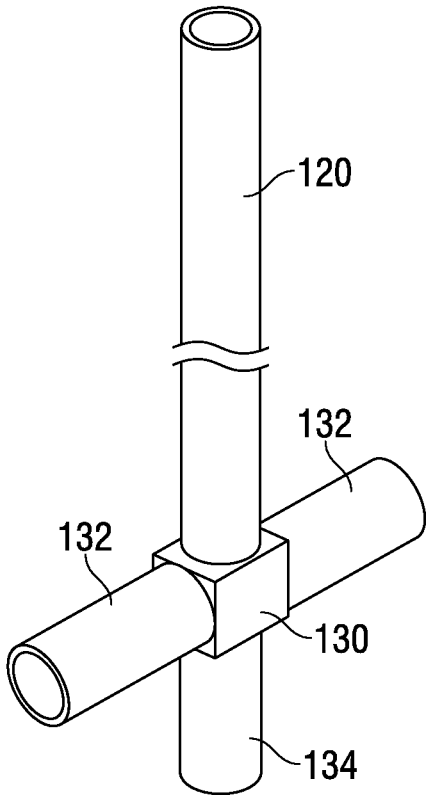
FIG. 6C illustrates one potential embodiment of the drive casing located interior to the tool head of one embodiment of the present invention.
Figure 6D:
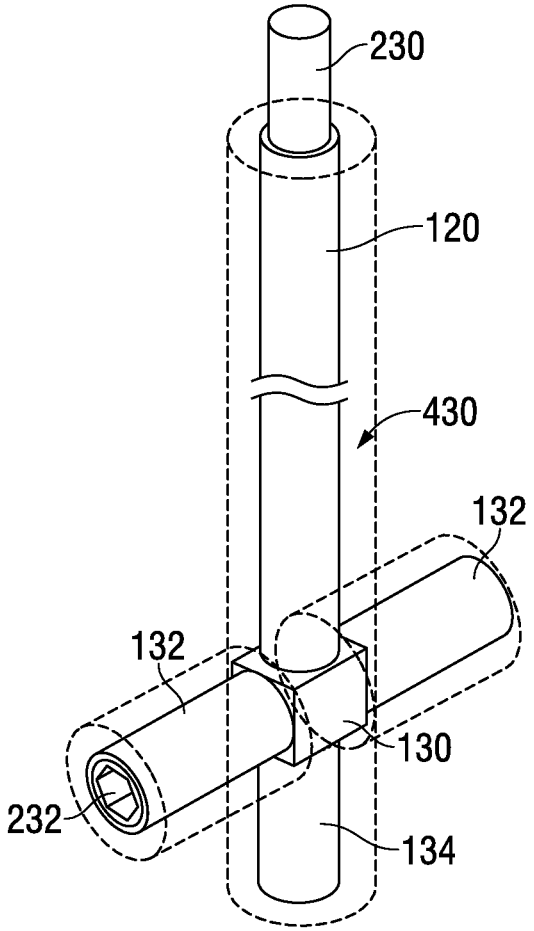
FIG. 6D illustrates one embodiment of the tool head with hidden lines to allow viewing of the interior of the drive mechanisms.

FIG. 6C illustrates the casing 120 of drive shaft 230 as it connects to gear box 130 and casings 132 and lower casing 134. Casings 120, 134 and 132 are hollow and form substantially the exterior non-rotating surface of tool head 30. FIG. 6D illustrates an assembled view in cut away of the lower tool head 30 with the interior casings of the drive shafts. As shown, drive shaft 230 in internal to casing 120. Drive shafts 232 are interior to casings 132. Gear box 130, which houses gears 300 in a manner known in the art is also encased in the tool head 30.

FIG. 7 illustrates a cut away view of the optional brush head 50. As shown, drive shaft 234 is attached to gear 350. Gear 350 is in mechanical communication with gear 360. Gear 360 is also in communication with gear 370. When in operation, gear 350 rotates inapposite to gear 360 and gear 370 rotates inapposite to gear 360. Brush heads 57 and 58 can attach to gears 360 and 370 via snap in orifices 361 as are known in the art.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

The invention claimed is:

1. A lint removal device comprising;
a hollow elongated member with a first and second end;
a hollow handle in mechanical attachment to said first end of said elongated member;
a tool head with gears in mechanical attachment to said second end of said elongated member;
brushes;
rotation motor and gears; wherein
said brushes are in rotational mechanical communication with said tool head gears;
said rotation motor and gears are enclosed in said elongated member and in rotational and mechanical communication with said tool head;
said hollow handle further comprising;
a power source in electronic communication with a control mechanism;
said control mechanism located with a user interface substantially on the exterior of said hollow handle;
said control mechanism and said power source in electric and mechanical communication with said rotation motor and gears; wherein
initiation of said power source can cause activation of said rotation motor and gears causing said gears of said rotation motor and gears to rotate; said rotation motor and gears rotating causes said head gears to rotate, therein causing said brushes to rotate.

2. The lint removal device of claim 1 further comprising;
a motor speed variation control; wherein
said motor speed variation control is attached to said handle and in electronic communication with said motor.

3. The lint removal device of claim 1 further comprising;
a lower brush head attachment; wherein
said lower brush head attachment is in mechanical communication with said tool head and will rotate when said gears are rotated.

4. The lint removal device of claim 1 further comprising;
said brushes rotate in contrary directions to each other about a central axis.

5. The lint removal device of claim 1 further comprising;
said brushes rotate in the same directions to each other about a central axis.

6. A method for using a lint removal device comprising the steps of;
obtaining a lint removal device comprising;
a hollow elongated member with a first and second end;
a hollow handle in mechanical attachment to said first end of said elongated member;
a tool head with gears in mechanical attachment to said second end of said elongated member;
brushes;
rotation motor and gears; wherein
said brushes are in rotational mechanical communication with said tool head gears; said rotation motor and gears are enclosed in said elongated member and in rotational and mechanical communication with said tool head;
said hollow handle further comprising;
a power source in electronic communication with a control mechanism;
said control mechanism located with a user interface substantially on the exterior of said hollow handle;
said control mechanism and said power source in electric and mechanical communication with rotation said motor and gears; wherein
initiating said power source can cause activation of said rotation motor and gears causing said gears of said rotation motor and gears to rotate; said rotation motor and gears rotating causes said head gears to rotate therein causing said brushes to rotate;
inserting said lint removal device into a lint containing area wherein said rotating brushes will remove lint from said lint container area through said rotation.

7. The method of claim 6 further comprising the steps of;
obtaining a motor speed variation control; wherein
attaching said motor speed variation control is attached to said handle and in electronic communication with said motor.

8. The method of claim 6 further comprising the steps of;
obtaining a lower brush head attachment; wherein
attaching said lower brush head in mechanical communication with said tool head and will rotate when said gears are rotated.

9. The method of claim 6 further comprising the steps of;
rotating said brushes in contrary directions to each other about a central axis.

10. The method of claim 6 further comprising the steps of;
rotating said brushes in the same directions to each other about a central axis.

11. A lint removal device comprising;
a hollow elongated member with a first and second end;
a hollow handle in mechanical attachment to said first end of said elongated member;
a tool head with gears in mechanical attachment to said second end of said elongated member;
brushes;

rotation motor and gears; wherein said brushes are in rotational mechanical communication with said tool head gears;

said rotation motor and gears are enclosed in said elongated member and in rotational and mechanical communication with said tool head;

said hollow handle further comprising;

a power source in electronic communication with the exterior of said hollow handle;

said power source in electric and mechanical communication with said rotation motor and gears; wherein initiation of said power source can cause activation of said rotation motor and gears causing said gears of said rotation motor and gears to rotate; said rotation motor and gears rotating causes said head gears to rotate therein causing said brushes to rotate.

12. The lint removal device of claim 11 further comprising;

a motor speed variation control; wherein said motor speed variation control is attached to said handle and in electronic communication with said motor.

13. The lint removal device of claim 11 further comprising;

a lower brush head attachment; wherein said lower brush head attachment is in mechanical communication with said tool head and will rotate when said gears are rotated.

14. The lint removal device of claim 11 further comprising;

said brushes rotate in contrary directions to each other about a central axis.

15. The lint removal device of claim 11 further comprising;

said brushes rotate in the same directions to each other about a central axis.

* * * * *